United States Patent [19]

Rogers, Jr.

[11] 4,108,491

[45] Aug. 22, 1978

[54] WALL-AVOIDING RECLINER CHAIR

[75] Inventor: Walter Clark Rogers, Jr., Denton, N.C.

[73] Assignee: Royal Development Company, Inc., High Point, N.C.

[21] Appl. No.: 789,958

[22] Filed: Apr. 22, 1977

[51] Int. Cl.[2] ..... A47C 1/02

[52] U.S. Cl. ..... 297/85; 297/86; 297/322; 297/342

[58] Field of Search ..... 297/68, 69, 83–87, 297/317, 320–322, 341, 342

[56] References Cited

U.S. PATENT DOCUMENTS

| | | | |
|---|---|---|---|
| 2,346,629 | 4/1944 | Travers | 297/342 |
| 2,593,145 | 4/1952 | Hoven et al. | 297/342 |
| 3,767,257 | 10/1973 | Rogers, Jr. et al. | 297/85 |
| 3,941,417 | 3/1976 | Ré | 297/322 X |
| 3,958,827 | 5/1976 | Ré | 297/322 X |

*Primary Examiner*—Roy D. Frazier
*Assistant Examiner*—William E. Lyddane
*Attorney, Agent, or Firm*—William E. Mouzavires

[57] ABSTRACT

A recliner chair with wall-avoiding action which permits the chair to be placed adjacent a wall without striking the wall when the chair is moved to reclining positions. The wall-avoiding action is achieved through a linkage which suspends the seat and its rigidly incorporated armrests, relative to a fixed base for swinging movement between a normal or generally upright position, and a number of reclining positions where the backrest extends rearwardly at an incline and the seat also extends at an incline. A handle-operated footrest is provided and an actuating and control link is connected between linkage which actuates the footrest and the linkage which mounts the seat to the base so as to move the latter forwardly relative to the base when the footrest is moved to extended position to provide a certain amount of wall-avoiding action. This actuating and control link prevents movement of the backrest relative to the seat when the chair is in normal position or is operated to extend the footrest. However, once the footrest is in extended to "TV" position, the backrest may be pivoted rearwardly relative to the seat to provide advanced reclining positions by the occupant exerting back pressure on the backrest. This also operates to swing the seat forwardly and upwardly relative to the base to provide further wall-avoiding action and also to position the seat in a comfortable reclining position. The chair is maintained in any of its positions by virtue of the balance of the linkage system, and no spring assists are needed to help to maintain position or move the chain into any new position.

34 Claims, 10 Drawing Figures

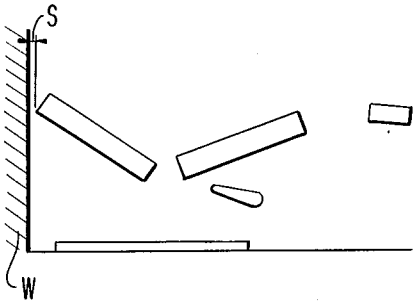
FIG 1c
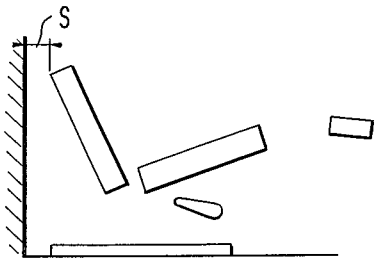
FIG 1b
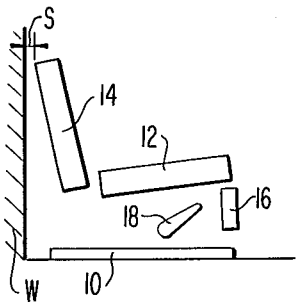
FIG 1a
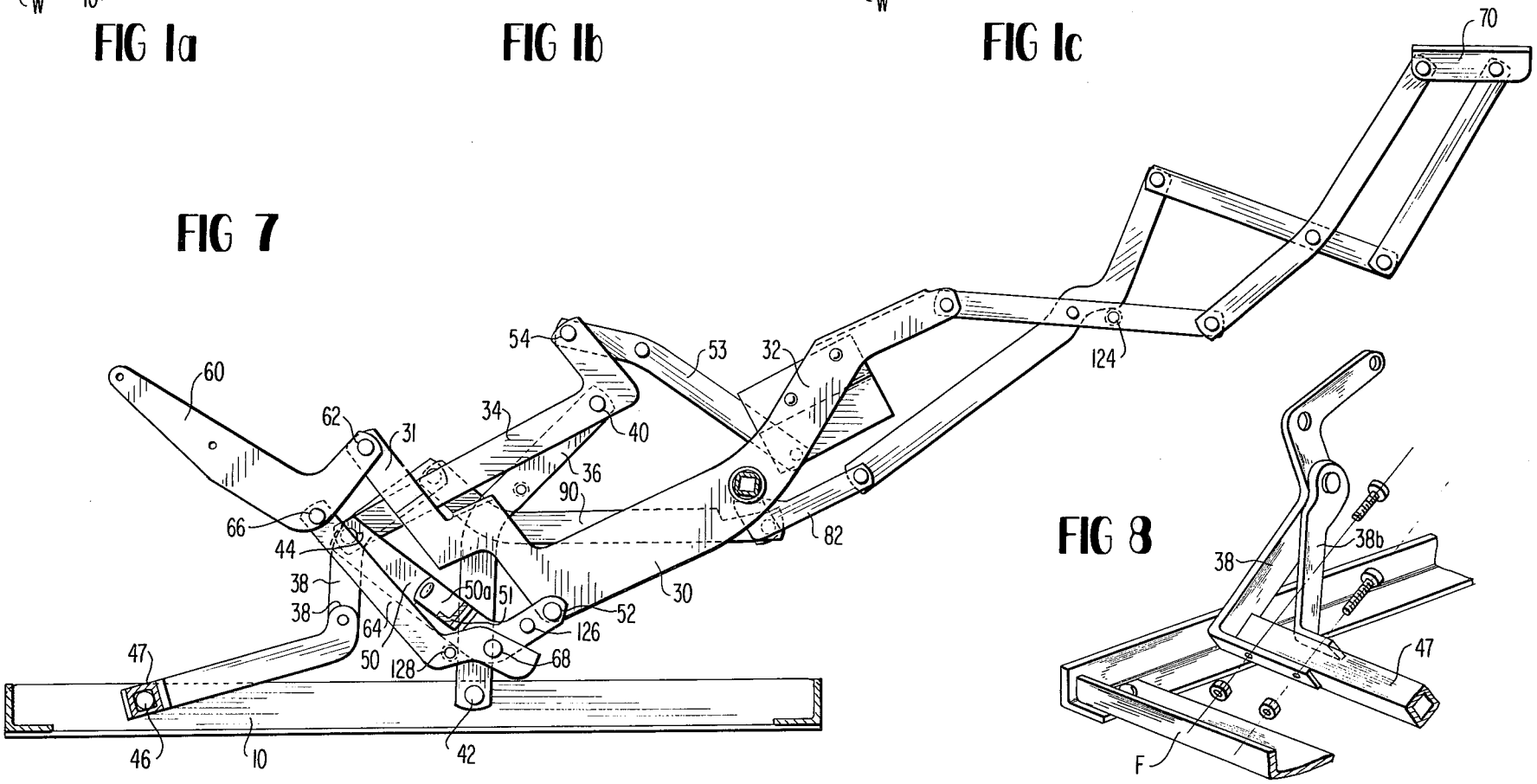
FIG 7
FIG 8

WALL-AVOIDING RECLINER CHAIR

RELATED APPLICATION

This application is related to my U.S. patent application Ser. No. 669,270, filed Mar. 22, 1976, now U.S. Pat. No. 4,071,275 entitled "Recliner Chair With Wall-Avoiding Action," assigned to the assignee of the present application.

OBJECTS OF INVENTION

The present invention generally relates to recliner chairs and more specifically to recliner chairs having a wall-avoiding action and which may be utilized adjacent a wall in a room without obstruction from the wall even when the chair is moved to reclining positions. More specifically, the present invention relates to a novel and improved three-way, handle-operated, wall-avoiding recliner chair of the type disclosed in my pending United States patent application identified above, although it is noted that, in certain respects, the present invention need not be limited to such type of recliner chair. The term "handle-operated" as referred to, means that the footrest of the chair is moved between extended and retracted positions by a linkage actuated through the use of a manually operated handle, usually positioned on one side of the chair. The term "three-way" recliner as utilized herein means that the seat is movable relative to a fixed base, and the backrest is movable relative to the seat.

One of the objects of the present invention is to provide an improved three-way, handle-operated, wall-avoiding recliner chair incorporating a novel linkage system which will move the seat and backrest of the chair forwardly relative to a fixed base when the footrest is extended or when the backrest is moved to reclining positions after the footrest has been extended. Included herein is the provision of such a linkage system which will place the seat and backrest as a unit into a comfortable reclining position when the footrest is extended and will subsequently elevate the footrest and incline the seat into comfortable positions as the backrest is reclined relative to the seat.

Another object of the present invention is to provide a novel and improved linkage system for a wall-avoiding reclining chair which will permit the chair to be moved into a number of different advanced reclining positions depending on the weight distribution of the chair occupant as selected by the occupant and which positions will be extremely comfortable and easily and accurately maintained by virtue of the balance of the linkage system responding to the weight distribution of the occupant. Included herein is the provision of such a linkage system which requires no spring mechanisms or similar mechanical assists for aiding movement of the chair to its various positions or for maintaining the chair in any of its reclining positions. Further included herein is the provision of such a linkage system which provides effective leverage for facilitating movement of the chair to its various positions without assist mechanisms such as springs.

Another object of the present invention is to provide a linkage mechanism for a wall-avoiding recliner chair which will achieve the above objects and yet is composed of relatively few linkage parts which may be economically manufactured for use in commercial chairs to meet present day styling requirements. Included herein is the provision of such a linkage mechanism that may be utilized in T-cushion chairs and furthermore which will permit the armrests of the chair to be united with the seat in one piece in contrast to prior wall-avoiding recliner chairs which have required that the armrests be formed separately from the seat in order to provide desired wall-avoiding action.

SUMMARY OF INVENTION

In summary, the above and other objects of the invention are achieved by a recliner chair having a fixed base which may be formed by any suitable structure, and a seat mounted to the base by a carrier link from which the seat is suspended by what will be termed a "suspension linkage". The carrier link is pivotally mounted for swinging movement relative to the base by what will be termed a "mounting linkage".

The chair is further provided with a footrest including a footrest linkage mounted to the seat for movement between extended and retracted positions under the operation of a footrest actuating linkage controlled independently of the backrest preferably by a handle mounted on one side of the chair to be easily grasped by the chair occupant. The mounting linkage is connected to the footrest actuating linkage by an actuating and control link for moving the seat forwardly relative to the base when the footrest is moved from retracted to extended position.

By means of a "backrest linkage", the backrest of the chair is pivotally mounted relative to the seat for movement between a normal or generally upright position and a number of various advanced reclining positions achieved by the occupant exerting back pressure on the backrest. However, the actuating and control link mentioned above prevents the backrest from being pivoted relative to the seat when the footrest is in retracted position so that it is necessary to first extend the footrest before moving the backrest relative to the seat into advanced reclining positions. The backrest is movable with the seat forwardly of the base due to its pivotal connection to the seat, when the footrest is moved to extended position, thus providing a certain amount of wall-avoiding action. During this latter phase, the angle between the backrest and seat remains the same, however, both parts move together as a unit into a first reclining position by virtue of movement of the seat into an incline position when the footrest is moved to extended position. The position of the chair is known in the trade as the "TV position".

In order to provide continued wall-avoiding movement of the seat forwardly relative to the base when the backrest is moved into advanced reclining positions beyond the TV position, an actuating link included in the backrest linkage, is provided interconnecting the backrest and the suspension linkage for moving the suspension linkage which, in turn, causes the mounting linkage to swing the seat forwardly relative to the base with wall-avoiding action as the backrest is being moved into advanced reclining positions. Although the chair is sufficiently sensitive to a change in the occupant's weight distribution to allow automatic adjustment into the various advanced reclining positions in accordance with the desires of the occupant, the chair is easily maintained in any of its positions through the balance of the linkage system and thus requires no spring assists to move or maintain the chair in its various positions.

The linkage system described above is utilized on both sides of the chair and these systems are interconnected by a plurality of stabilizer cross members to prevent side sway of the seat. In addition, the footrest actuating linkages on opposite sides of the chair are interconnected by a common drive shaft mounted in the seat and which is actuated in rotation at one end by the handle to extend or retract the footrest.

DRAWINGS

Other features and objects of the invention summarized above will become apparent from the following more detailed description taken in conjunction with the drawings in which:

FIG. 1A is a schematic representation of a side view of a chair embodying the present invention and shown in generally upright or normal position relative to a vertical wall at which the chair is closely situated;

FIG. 1B is a view similar to FIG. 1A except that the chair has been moved to the TV position, that is, with its footrest extended and with the seat and backrest having been moved together as a unit into a first reclining position;

FIG. 1C is a view generally similar to FIG. 1B except that the chair has been moved into a fully reclining position;

FIG. 7 is a view generally similar to FIG. 6 except with the linkage mechanism shown in the fully reclined position corresponding to that illustrated in FIG. 1C; and FIG. 8 is a perspective view of certain linkage parts included in the chair.

DETAILED DESCRIPTION

SUMMARY OF CHAIR POSITIONS

Figures 2, 3:
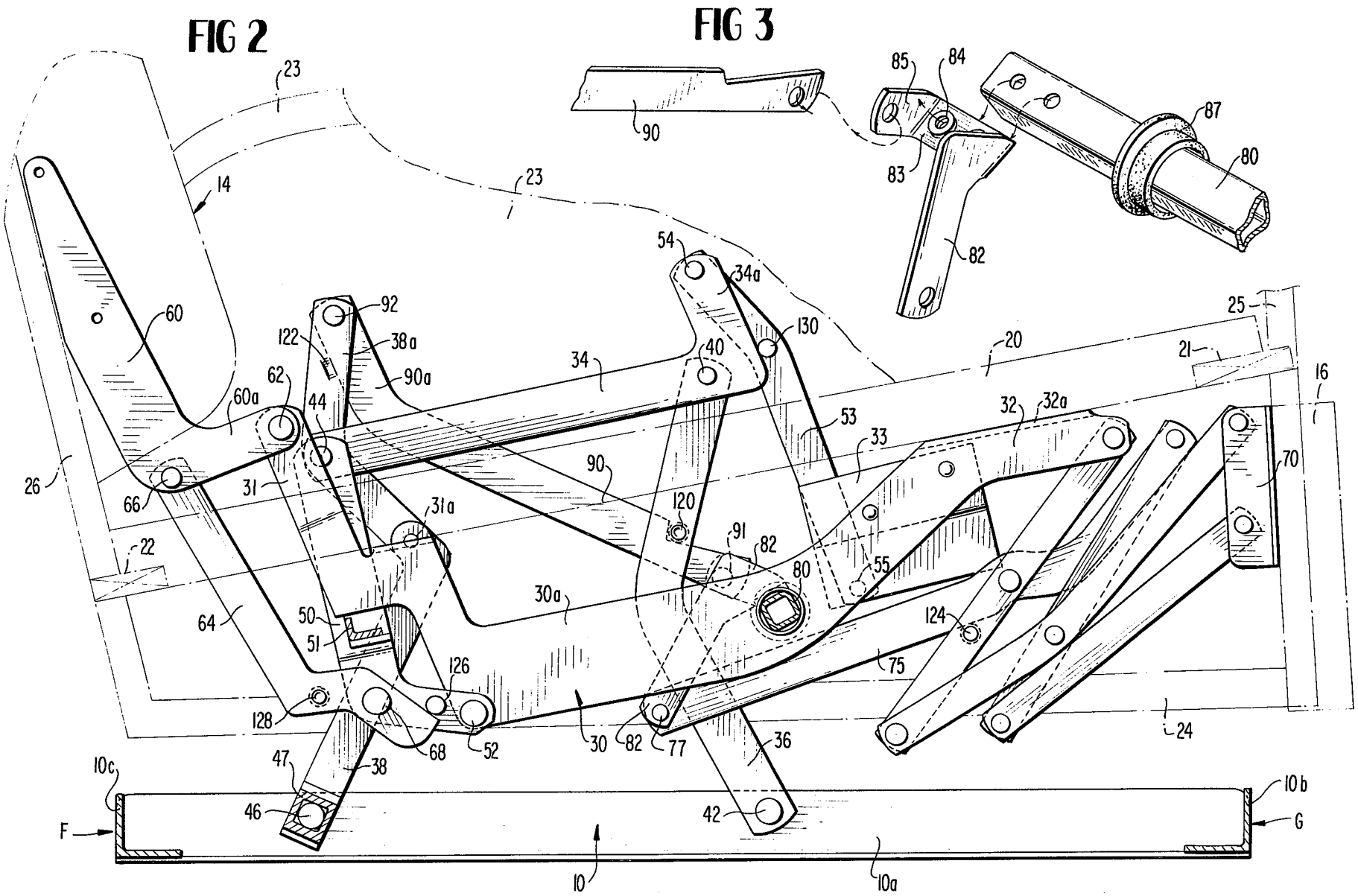
FIG. 2 is a side elevational view as seen from within the chair, of a linkage mechanism embodying the present invention and which is located on one side of the chair; the mechanism being shown in the position it occupies when the chair is in the normal or upright position corresponding to that illustrated in FIG. 1A.
FIG. 3 is a perspective, assembly view of certain links and a footrest actuating shaft illustrating assembly of these parts, with certain of the parts shown in fragment.

Referring now to the drawings in detail, there is shown for illustrative purposes only, a three-way, handle-operated, wall-avoiding recliner chair constituting a preferred embodiment of the present invention. With reference to the schematic representation shown in FIG. 1A, the chair includes a fixed base 10 which rests on the floor, a seat 12 mounted by a seat linkage system to be described for movement relative to the base, a backrest 14 mounted relative to the seat for movement with the seat and for movement relative to the seat through means of a backrest linkage to be described; and a footrest generally designated 16 mounted by a footrest linkage to be described for movement between a retracted position shown in FIG. 1A and an extended position projected forwardly from the chair as shown in FIG. 1B. Actuation of footrest 16 between the extended and retracted position is achieved independently of the backrest preferably through a manual control handle 18 mounted on one side of the chair. Although not shown in FIG. 1A, the chair includes armrests fixed rigidly to seat 12 to move together with the latter as a unit. FIG. 1A shows the position of the basic chair parts which may be termed the "normal" or upright position where the seat extends generally in a horizontal plane but is at a slight incline as shown, the backrest extends upwardly in a generally vertical plane but at a slight incline as shown; and the footrest is in a retracted position extending generally in a vertical plane as shown. Note the chair is shown as positioned adjacent a wall W with a slight space S between backrest 14 and wall W.

Referring to FIG. 1B, the chair has been moved to what is known as a "TV" position in which the footrest 16 has been projected by operation of handle 18, and seat 12 has been moved forwardly relative to base 10 and also placed into a slightly steeper incline relative to the horizontal. By virtue of its connection to the seat, backrest 14 has also moved forwardly relative to the base 10 and also into a first reclining position but the angle between backrest 14 and seat 12 has remained the same. Note that the space S between the backrest and the wall W has increased in the TV position shown in FIG. 1B, this being achieved by the wall-avoiding action in which the seat moves forwardly relative to the base when the footrest is extended.

FIG. 1C shows the chair in the full recline position where the backrest has been pivoted rearwardly relative to the seat and the seat has moved forwardly relative to the base and also has been swung upwardly into a steeper incline which, in turn, also has caused the footrest to be elevated in contrast to the TV position shown in FIG. 1B. Note that the space S between the backrest and the wall has decreased but the chair has been placed into a full recline position without obstruction from the wall W. Although the seat has been moved forwardly relative to the base when moving from the TV to the full recline position shown in FIG. 1C, the rearward pivoting of the backrest 14 relative to seat 12 results in the decreased space S between the backrest and the wall W. It is, of course, understood that the movement of the chair between the positions shown in FIGS. 1A, 1B and 1C is achieved by the chair occupant (not shown) who manipulates control handle 18 to place the chair in the TV position shown in FIG. 1B after which the occupant exerts back pressure against backrest 14 to move it into the full recline position shown in FIG. 1C.

Between the TV position of FIG. 1B and the full recline position of FIG. 1C, the chair may be moved into any number of intermediate, advanced reclining positions (not shown) under the control and in accordance with the desires of the chair occupant depending on the back pressure applied to the backrest 14 and the distribution of the occupant's weight in the chair. If the occupant is in the full recline position shown in FIG. 1C and desires to return to the TV position shown in FIG. 1B, he merely leans forwardly in the chair shifting his weight and the balance of the linkage system, to be described, will automatically restore the chair to the TV position shown in FIG. 1B. By the same control, the occupant may easily place and maintain the chair in any number of advanced reclining positions between the TV and full recline positions.

ONLY THE LINKAGE OF THE OCCUPANT'S LEFT IS SHOWN

Figure 4:
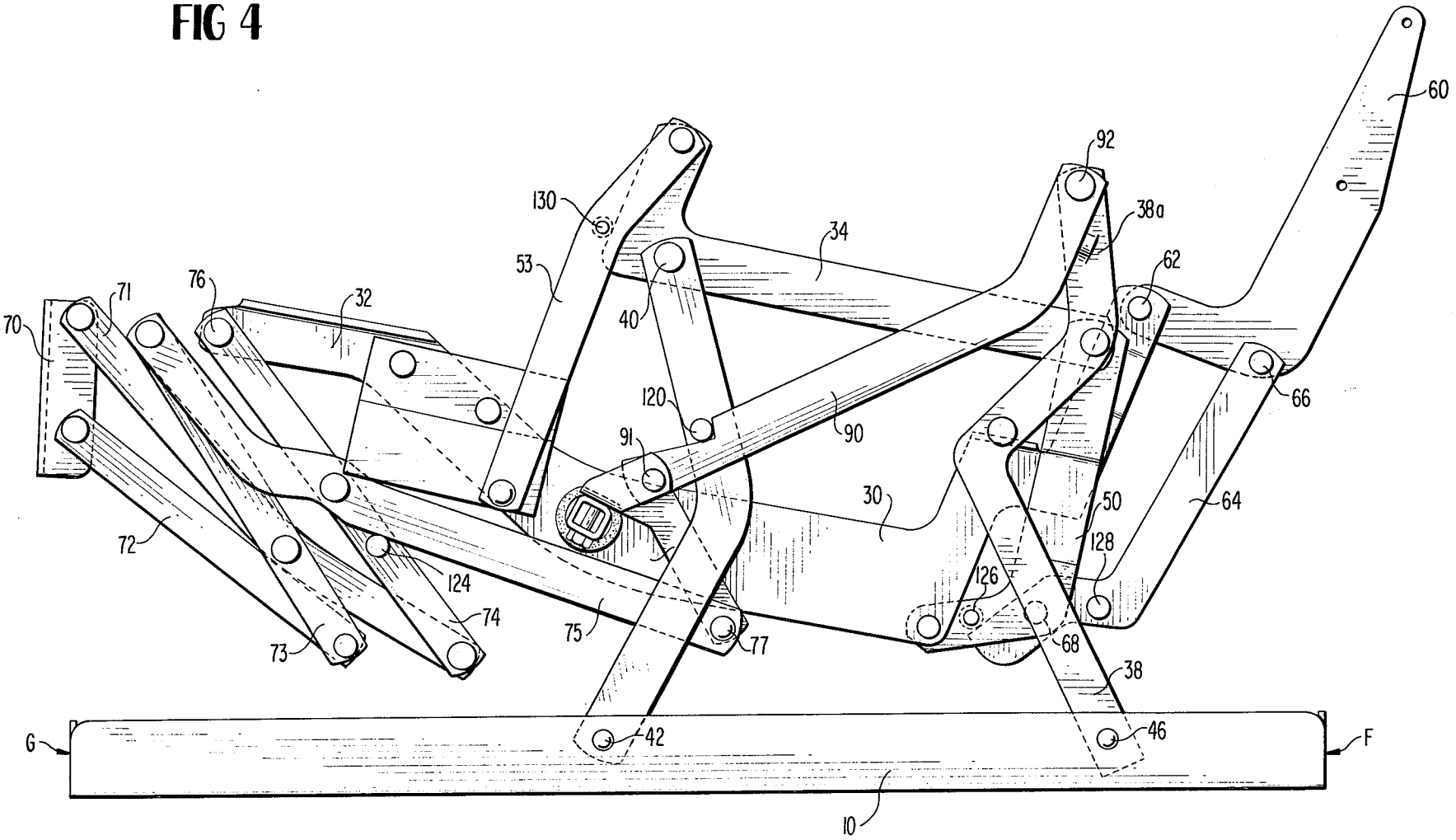
FIG. 4 is a side elevational view of the linkage mechanism shown in FIG. 2 but as seen from the outside of the chair.

The linkage system for the chair parts described above in connection with FIGS. 1A, 1B and 1C includes two linkage mechanisms on each side of the chair, one mechanism being a mirror image of the other except for the control handle 18 which is usually positioned on the right-hand side of the chair, that is, the side that would be on the right of the chair occupant. For the purposes of the present description, only one linkage mechanism need be described, and with reference to FIG. 2, there is shown one mechanism that is positioned on the left-hand side of the chair, that is, the side that would be positioned on the left of the chair occupant. FIG. 2 shows this linkage mechanism as would be seen from within the chair looking outwardly to the left of the chair occupant. The same linkage mechanism is seen from a point outside the chair looking towards the chair as shown in FIG. 4.

THE CHAIR FRAME

The frame of the chair parts which include the upholstery, is shown in FIG. 2 as including seat side rails 20 (one shown) interconnected by front and rear frame cross pieces 21 and 22 and being fixed to the armrest frame which includes an upper armrest rail 23 and a lower armrest rail 24 interconnected by front and rear vertical frame members 25 and 26 which are joined to side rails 20. As will be described, the linkage mechanism at each side of the chair mounts the unitary set and armrest frame relative to the base 10 which includes opposite side frame members 10*a* joined at the front and rear ends thereof by frame members 10*b* and 10*c*. Although the base frame members may be made from any suitable material such as wood, they are shown in FIG. 2 as being made from steel angle members. The frame parts of the seat and armrests are shown as being made from wood, although any other suitable material may be employed.

THE SEAT LINKAGE

Figure 5:
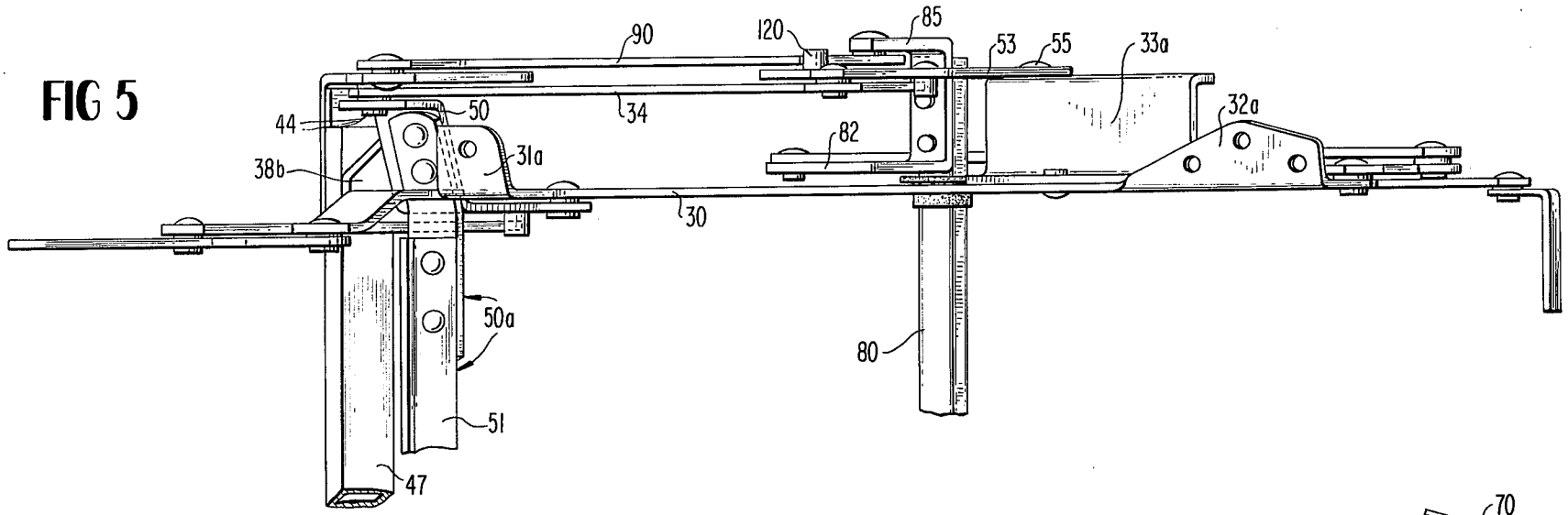
FIG. 5 is a plan view of the linkage mechanism shown in FIG. 2 but omitting the base of the chair.

Seat 12 is mounted relative to base 10 by what is termed a "seat linkage". Referring to FIG. 2, this linkage includes what will be referred to as a "seat" link generally designated 30 extending in the forward-rearward direction of the chair and including a central portion 30*a* and raised rear and front portions 31 and 32 which have formed thereon outwardly projecting mounting flanges 31*a* and 32*a* defining seats for securement of seat rail 20 as shown in FIG. 2 so that the seat link 30 moves as a unit with the seat frame. A top view of the flanges 31*a* and 32*a* is shown in FIG. 5. Seat link 30 and the associated seat frame 20 is suspended from what will be referred to as a "carrier" link 34 which is shown as being a generally straight link having a crank portion 34*a* projecting upwardly at the forward end thereof. This suspension is achieved by what will be referred to as a "suspension" linkage including a rear suspension link 50 having its upper end pivoted by pivot pin 44 to the rear end of carrier link 34 and its lower end which is shown as cranked, pivoted by a pivot pin 52 to the central portion 30*a* of seat link 30. The suspension linkage further includes a front suspension link 53 having its upper end pivoted by pivot pin 54 to the upper extremity of crank 34*a* of carrier link 34, and its lower end pivoted by a pivot pin 55 to the forward portion 32*a* of seat link 30. The latter connection is effected in the shown embodiment of a flanged bracket 33 fixed to seat link portion 32 and receiving pivot 55 for a purpose to be described below. It will be seen that a closed four-bar linkage is formed by carrier link 34, seat link 30 and suspension links 50 and 53.

The closed four-bar linkage comprised of carrier link 34, seat link 30 and suspension links 50 and 53, is mounted relative to the base 10 for swinging movement in the forward-rearward direction of the chair relative to base 10 by means of what will be referred to as a "mounting" linkage. The mounting linkage includes a front mounting link 36 shown as having a generally wingshape, whose upper end is pivoted by pivot pin 40 to a forward portion of carrier link 34 and whose lower end is pivoted by pivot pin 42 to base 10. The mounting linkage further includes a rear mounting link 38 spaced rearwardly from front mounting link 36 and shown as having a generally flattened Z-shape or serpentine shape. An upper intermediate portion of rear mounting link 38 is pivoted by pivot pin 44 to the rear end portion of carrier link 34 while the lower end of rear mounting link 38 is pivoted by pivot pin 46 to the base 10. Pivot pin 44 which connects rear mounting link 38 to carrier link 34 is the same pivot pin which connects rear suspension link 50 to carrier link 34 as described above. It will be seen that carrier link 34, front and rear mounting links 36 and 38 and base 10 form another closed four-bar linkage.

In operation, pivotal movement of mounting links 36 and 38 in the forward or rearward direction of the chair relative to base 10 will serve to swing the first four-bar linkage (links 34, 30, 50 and 53) in a vertical plane in the same direction along an arc. This movement is employed to not only place the seat 12 into comfortable reclining positions but also to move the seat forwardly relative to base 10 in wallaway action to enable the chair to be utilized adjacent the wall such as W described above in connection with FIGS. 1A, 1B and 1C.

THE BACKREST LINKAGE

As noted above, movement of the chair from the TV position shown in FIG. 1B to the full reclining position shown in FIG. 1C is effected by the chair occupant exerting back pressure on backrest 14. This will have the effect of actuating both four-bar linkages as will be further described below for swinging the chair forwardly and upwardly in the comfortable reclining positions as backrest 14 pivots rearwardly relative to seat 12. The linkage for achieving this phase of movement will be termed the "backrest" linkage, and in the shown embodiment, it includes what will be referred to as "backrest" link 60 shown as having a generally L-shape which is fixed to the backrest frame along its longitudinal portion and which has a lower crank portion 60*a* pivoted by pivot pin 62 to the upper portion 31 of seat link 30. In addition, backrest link 60 at the juncture between its crank portion 60*a* and its main body portion is pivoted by pivot pin 66 to a link 64 which will be referred to as an "actuating" link (for advanced reclining) whose lower end is pivoted by pivot pin 68 to rear suspension link 50. Actuator link 64 is shown as having its lower portion cranked, as is the lower portion of backrest suspension link 50. It will be seen that a closed four-bar linkage is formed by the lower crank portion 60*a* of backrest link 70, actuator link 64, the rear end portion 31 of seat link 30, and the lower crank portion of rear suspension link 50.

THE FOOTREST LINKAGE

Figure 6:
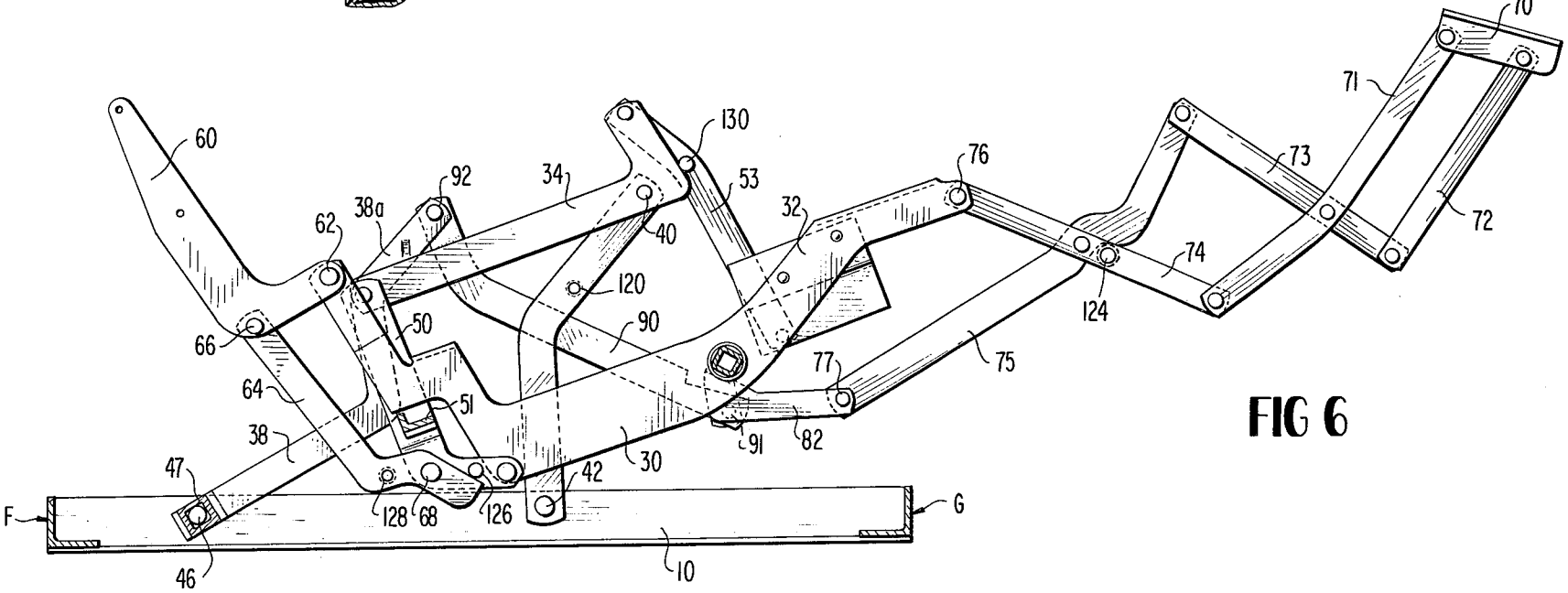
FIG. 6 is a view generally similar to FIG. 2 except that the linkage mechanism is shown in the TV position corresponding to that illustrated in FIG. 1B, and certain frame parts of the chair are omitted.

Footrest 16 is mounted to the seat for movement between extended and retracted positions by means of what will be termed a "footrest" linkage which may include a lazy-tong or accordian linkage. Referring to FIG. 6, this linkage includes a bracket link 70 adapted to be suitably fixed to the footrest frame, and a pair of generally parallel links 71 and 72 having their ends pivoted to bracket 70. Parallel links 71 and 72 are pivotally connected to another pair of generally parallel links 73 and 74. Link 73 has one end pivoted to the end of link 72 and further has an intermediate portion pivoted to an intermediate portion of link 71. Link 74 forms a footrest mounting link having one end pivoted by pivot pin 76 to the forward end portion 32 of seat link 30 and having its opposite end pivoted to the extremity of link 71. Link 75 is connected to a footrest actuating mechanism to be described for transmitting movement to the remainder of the footrest linkage to move the same between an open position (TV) shown in FIG. 6 where the footrest is extended or to a closed position shown in FIG. 2 where the footrest is retracted.

THE FOOTREST ACTUATING LINKAGE

Referring now to FIGS. 2 and 3, the footrest linkage is actuated to extend or retract footrest 16 by means of a footrest actuating linkage including a crank 82 having a mounting flange 83 projecting at right angles therefrom for securement to the side wall of drive shaft shown as a metallic tube 80; securement being by bolts passing through apertures 84 formed in drive shaft 80 and mounting flange 83. Drive shaft 80 is mounted in the seat links 30 on both sides of the chair, that is, in the linkage mechanisms on both sides of the chair for rotation about its longitudinal axis which extends transversely across the chair. This mounting is effected by apertures formed in the seat links 30 on opposite sides of the chair and by a suitable bearing, such as a flanged teflon or nylon bearing 87 (see FIG. 3) which is received about drive shaft 80 and which is also received in the apertures of seat links 30. Drive shaft 80 is secured in any suitable manner to the manual control handle 18 so that rotation of manual control handle 18 will have the effect of rotating drive 80 about its longitudinal axis which, in turn, will have the effect of rotating crank 82 about the longitudinal axis of drive shaft 80. Motion is transmitted from crank 82 to the footrest linkage for extending and retracting the same upon rotation of drive shaft 80 by means of a pivotal connection provided by pivot pin 77 of crank 82 to the rear end of link 75 of the footrest linkage.

It will be seen that upon counterclockwise rotation of the drive shaft 80 from the position shown in FIG. 2, crank 82 will also be moved in a counterclockwise direction which will have the effect of projecting footrest link 75 forwardly to open the footrest linkage while projecting the footrest forwardly to the extended position shown in FIG. 6. Opposite rotation of the drive shaft 80 from the extended position shown in FIG. 6 will, of course, have the effect of returning the linkage to the closed position shown in FIG. 2 with the footrest retracted below the front of the seat. In order to limit and define the projected position of the footrest when in the TV position shown in FIG. 6, a stop 124 is suitably fixed to footrest mounting link 74 to engage the lower edge of link 75 to prevent further extension of the footrest linkage beyond that shown in FIG. 6. Stop 124 remains engaged against link 75 throughout movement of the chair between TV and full recline positions as shown in FIGS. 6 and 7.

ACTUATING AND CONTROL LINK

In order to move the seat forwardly and upwardly along an arc relative to base 10 when the footrest is moved to the TV position shown in FIG. 6 from the closed position shown in FIG. 2, for providing wall-avoiding movement and also for placing the seat in a comfortable incline for TV-position-reclining, an actuating and control link is connected between the mounting linkage and the footrest actuating linkage. In the preferred embodiment, this actuating and control link is provided by link 90 pivoted at one end by pivot pin 91 to the footrest actuating crank 82 and pivoted at an opposite crank portion **90*a* to the crank portion 38*a* of rear mounting link 38 by pivot pin 92. When the linkage is in the closed position shown in FIG. 2, pivot 91 between actuating and control link 90 and crank 82 is generally aligned with the axis of drive shaft 80 in the longitudinal direction of link 90. When drive shaft 80 is rotated in a counterclockwise direction as viewed in FIG. 2 by control handle 18 to project the footrest to extended position, pivot 91 will move in an arc about the axis of drive shaft 80 downwardly and forwardly and then upwardly which will have the effect of pulling with it link 90 which, in turn, will cause mounting link 38 to pivot clockwise about its pivot 46 to the base 10. This, of course, will have the effect of moving the first mentioned four-bar linkage, including carrier link 34, seat link 30 and suspension links 50 and 53, forwardly relative to the base. Inasmuch as suspension links 50, 53 would have a tendency to swing in a clockwise direction as viewed in FIG. 2, stop means are provided for preventing such movement. In the shown embodiment, such stop means include a stop such as pin 130 fixed to the side of front suspension link 53 to be engageable with the forward edge of crank portion 34*a* of carrier link 34; and a stop such as a pin 126 fixed to the side of the lower crank portion of rear suspension link 50 to engage the lower forward edge of actuating link 64 associated with the backrest. During movement of the chair to the TV position, the positions of carrier link 34 and seat link 30 relative to each other remain fixed by virtue of stops 130 and 126 in engagement with carrier link 34 and link 64, respectively. However, the entire four-bar linkage 30, 34, 50 and 53 is tilted (counterclockwise as shown in FIGS. 2 and 6) by mounting links 36 and 38 which rotate clockwise about pivots 42, 46 under actuation by link 90 as the chair moves to TV position of FIG. 6**.

As noted above, when the chair is in the normal position with the linkage mechanism closed as shown in FIG. 2, the backrest 60 cannot be reclined relative to the seat and this is achieved by the provision of another stop means which, in the preferred embodiment shown, includes a stop pin 120 fixed to an intermediate portion of front mounting link 36 so as to be received in a slot **90*b* formed along an edge portion of actuating and control link 90 as shown in FIGS. 2 and 4. Thus, when the chair is in the normal position shown in FIGS. 2 and 4, any pressure exerted rearwardly on backrest 14, 60 will be transmitted to link 64 which, in turn, will be transmitted to rear suspension link 50, however, this will have no effect on swinging suspension links 50 and 53 forwardly because stop 120 will engage the edge of actuating and control link 90 in slot 90*b* as shown in FIG. 2 to prevent such movement. When, however, the footrest is moved to the extended position, the forward end portion of actuating and control link 90 will be moved downwardly by crank 82 to remove stop 120 from engagement with actuating and control link 90 such that when the chair is in the TV position shown in FIG. 6, actuating and control link 90 will be free of stop 120 to permit the backrest to be moved relative to the seat into advance reclining positions. As described above, this is achieved by the occupant exerting back pressure against the backrest which will be transmitted to actuating link 64 which, in turn, will be transmitted at pivot 68 to rear suspension link 50 causing it, together with front suspension link 53, to swing forwardly and upwardly about an arc in counterclockwise direction as viewed in FIGS. 6 and 7 to place the chair in the desired advanced reclining position. It should be noted that during movement of the chair from the closed position shown in FIG. 2 to the TV position shown in FIG. 6. although stop 120 will be removed from slot 90*b* in the actuating and control link 90, stop 120 will still be engageable (in a manner not shown) with the upper edge of actuating and control link 90** to limit and prevent reclining movement of the backrest relative to the seat as the chair moves to TV position.

As the chair is moving from the TV to advanced reclining positions towards the full recline position shown in FIG. 7, not only will the suspension links 50 and 53 be swung forwardly and upwardly along an arc relative to carrier link 34 but also mounting links 36 and 38 will swing forwardly relative to the base 10 about pivots 42 and 46 so that the seat will be moved forwardly relative to the base and also will be placed at a steeper incline for relaxed reclining appropriate to the reclining angle of the backrest and the position of the footrest which will also be elevated progressively by virtue of the upward arc of movement of seat link 30 produced by suspension links 50 and 53.

The full recline position shown in FIG. 7 will be determined by another stop means which, in the preferred embodiment shown, includes a stop pin 128 fixed to a bottom portion of actuating link 64 to be engageable with the rear edge of rear suspension link 50 at the full recline position shown in FIG. 7. Throughout movement of the chair between the TV position shown in FIG. 6 to the full recline position shown in FIG. 7, stop 124 in the footrest linkage remains engaged with link 75 to maintain the footrest linkage parts in the same relative positions.

It will be seen that the linkage system of the present invention provides excellent balance permitting any number of reclining positions to be achieved between the TV position shown in FIG. 6 and the full recline position shown in FIG. 7 without the aid of any springs or similar assist devices. During such movement to the various advanced reclining positions, the position of the linkage is governed by the amount of back pressure applied to the backrest by the occupant and once a desired advanced reclining position is achieved, the chair will remain in that position solely by virtue of the balance of the linkage system. This balance is smoothly controlled during movement of the chair to the advanced reclining positions because as greater pressure is exerted on the backrest to achieve an advanced reclining position, suspension links 50 and 53 progressively swing upwardly in a counterclockwise direction about carrier link 34 to provide progressively increasing force counterbalancing the increased pressure on the backrest. This counterbalancing force imposed by the suspension links 50 and 53 is augmented by the fact that the carrier link 34 under actuation by mounting link 38 moves into a steeper incline as the chair is moved into advance reclining positions.

By way of further explanation of the linkage system, it should be noted that in the closed position of the linkage system shown in FIG. 2, front mounting link 36 has not reached the top of its arc, that is, pivot 40 is to the left of pivot 42 as shown in FIG. 2. Therefore, front mounting link 36 would normally have a tendency to swing in a counterclockwise direction as viewed in FIG. 2, that is, rearwardly but this is prevented by the actuating and control link 90 which is restrained by virtue of its connection to crank 82 (of the footrest actuating mechanism) whose positioning prevents any movement of actuating and control link 90 in the direction that would be necessary in order to permit mounting link 36 to swing rearwardly.

In the preferred embodiment, in order to prevent rivet slack that would cause slight movement by virtue of the natural tendency of front mounting link 36 to swing rearwardly about its pivot 42 when the linkage mechanism is in the closed position shown in FIG. 2, a stop 122 is provided on the upper crank portion **38*a* of rear mounting link 38 to engage the rear edge of crank 90*a* of actuating and control link 90 as shown in FIGS. 2 and 4. This engagement of stop 122 with the rear edge of crank portion 90*a* provides an added feature in that it increases the leverage available for initially moving rear mounting link 38 forwardly about its pivot 46 to the base 10 when the footrest is initially actuated from the retracted position shown in FIG. 2 to the extended TV position shown in FIG. 6. In achieving this leverage, the engagement of crank 90*a* against stop 122 in effect unites the upper crank portion 38*a* of mounting link 38 and the actuating and control link 90 as one piece so that the lever arm (or moment arm) for pivoting rear mounting link 38 about its pivot 46 to base 10 when the footrest is initially extended, is equal to the distance between the pivot 91 (connecting crank 82 to the actuating and control link 90) and the pivot 92 (connecting actuating and control link 90 to the upper end of mounting link 38). Thus, even though the natural tendency of front mounting link 36 to swing rearwardly since it has not reached the top of its arc when in the position shown in FIG. 2, exerts pressure on the actuating and control link 90 which restrains such movement of the front mounting link 36, the uniting of actuating and control link 90 and rear mounting link 38 as one piece achieved through stop 122, provides effective leverage for easily initiating movement of the footrest to the TV position while swinging rear mounting link 38 forwardly about its pivot 46 to the base. As the footrest continues its travel towards its fully extended position, stop 122 will, of course, become disengaged from actuating and control link 90 and the same effective leverage as described above will no longer exist, however, at that point in the travel, front mounting link 36 will have passed beyond its center of travel (beyond the top of its arc), that is, its pivot 40 to carrier link 34 will be to the right of pivot 42 as viewed in FIGS. 2 and 6** and gravity will provide the assistance to make extension of the footrest a smooth and simple procedure.

As described above, the TV position of the chair as shown in FIG. 6 is limited and governed by engagement of stop 124 on link 74 with the edge of link 75. In this TV position, rear mounting link 38 is beyond the top of its arc, that is, to the right of its pivot 46 to the base 10 as viewed in FIG. 6 and therefore the weight of the occupant exerted through actuating and control link 90 will easily keep the footrest linkage in the extended position. Also, it should be noted that in the TV position, pivot 91 between actuating and control link 90 and crank 82 is no longer aligned with drive shaft 80 but is rather offset as shown in FIG. 6 with the link 90 passing below the drive shaft 80. Thus, the weight of the occupant acting through actuating and control link 90 will help to easily maintain the footrest in the extended position.

In the TV position shown in FIG. 6 a uniquely balanced situation exists. That is, rear mounting link 38 will not be permitted to swing forwardly and downwardly to put the linkage system in further recline because it is countered by suspension links 50 and 53 which have a tendency to move in the opposite direction. However, when moving towards the full recline position shown in FIG. 7 from the TV position shown in FIG. 6, the occupant's pressure against the backrest will enable him to overcome the opposition of suspension links 50 and 53 to swing the latter links (counterclockwise) upwardly relative to carrier link 34 to obtain reclining movement as desired. As the reclining movement becomes more pronounced by the occupant exerting more back pressure on the backrest, the arc of travel of suspension link 53 also becomes more pronounced upwardly so that the balance is maintained at each progressive point of reclining movement. Therefore, it will be seen that in any of the advanced reclining positions there is complete balance provided by the first four-bar linkage comprised of carrier link 34, suspension links 50 and 53 and seat link 30 and the second four-bar linkage provided by carrier link 34, mounting links 36 and 38 and the base 10 which acts counter to the first four-bar linkage in a completely balanced relationship.

In order for the occupant to move the chair from any advanced reclining position to the TV position, he merely has to lean forwardly in the chair to redistribute his weight and the first and second four-bar linkages will adjust to provide a new balanced situation. The footrest, of course, may be retracted from the TV position to the closed position by rotation of the control handle 18 in the clockwise direction.

In the preferred embodiment of the invention shown, the linkages on the opposite sides of the chair are stabilized against side sway and to ensure that they act in unison by means of a pair of cross stabilizer members there being two utilized in the preferred embodiment shown. As shown in FIGS. 5 and 8, one stabilizer 47 is shown as a metallic tube interconnecting the bases of the bottom portions of rear mounting links 38 about their pivots 46 to the base 10. The other stabilizer is shown as an angle member 51 fixed to and between the rear suspension links 50 of the linkage mechanisms on opposite sides of the chair. As shown in FIG. 5, stabilizer 51 is fixed to straps **50*a* which project inwardly from rear suspension links 50 to which they are suitably fixed such as by bolts. In addition, in the preferred embodiment, added support is provided by struts 38*b* fixed at one end such as by bolts to a stabilizer 47 and fixed at the other end to rear mounting links 38 as shown in FIG. 8**.

In order to achieve the proper suspension of seat link 30 from carrier link 34 by means of suspension linkage 50 and 53 in order to provide the desired movement, carrier link 34 in the preferred embodiment, must be raised sufficiently above seat link 30 as illustrated in FIG. 2. In assembling the linkage to the chair frame, carrier link 34 is received in the hollow of the armrest above seat frame rail 20 and further is spaced outwardly from seat link 30 as illustrated in FIG. 5. As mentioned above, bracket 33 is fixed to the forward portion 32 of the seat link 30 and has an outwardly extending flange portion **33*a* to which front suspension link 53 is pivoted by pivot pin 55 as shown in FIGS. 2, 4 and 5. Further, as shown in FIG. 5, rear suspension link 50 has its upper portion offset from its lower portion so as to enable pivotal connection by pivot pin 44 to the carrier link 34** as described.

Although the balanced seat linkage system of the present invention has been shown and described herein as incorporated in a three-way, handle-operated recliner chair to which it is particularly suited, it should be understood that it has applicability elsewhere in other types of recliner chairs which need not be handle-operated in controlling the footrest. Indeed by appropriate modifications (not shown) to the actuating and control link 90 and the footrest actuating mechanism 80, 82, it will be possible to change the sequence of operation between the footrest and backrest even to the point where the footrest may be actuated by the backrest. Therefore, all of the claims need not be limited to the preferred embodiment of the invention shown and described.

What is claimed is:

1. A reclining chair comprising in combination: a base, a seat, seat linkage means mounting the seat relative to the base for movement forwardly or rearwardly relative to the base as well as for movement into different reclining positions extending at an angle to the horizontal relative to the base, said linkage means including a carrier link, a seat link fixed to the seat, suspension linkage suspending the seat link from the carrier link for pivotal movement relative to the carrier link, and a mounting linkage pivotally mounting said carrier link relative to the base; a backrest, backrest linkage means pivotally mounting the backrest relative to the seat for movement between a substantially upright position and a number of reclining positions; a footrest, footrest linkage means mounting the footrest relative to the seat for movement between a retracted position adjacent the seat and an extended position projected forwardly from the seat, footrest actuating linkage means independent of the backrest for moving the footrest linkage means to position the footrest in said retracted or extended positions; and an actuating and control linkage interconnecting the footrest actuating linkage means and the mounting linkage for moving the mounting linkage forwardly relative to the base when the footrest is moved to said extended position.

2. The recliner chair defined in claim 1 wherein said backrest linkage means includes an actuator link pivotally connected to the suspension linkage for moving the suspension linkage forwardly relative to the carrier link upon exertion of pressure against the backrest.

3. The recliner chair defined in claim 2 wherein said footrest actuating linkage means is mounted to said seat such that said actuating and control linkage interconnects said mounting linkage and said seat.

4. The recliner chair defined in claim 3 including a first stop means engageable with the actuating and control linkage when the footrest is in the retracted position to prevent movement of the actuating and control linkage in one direction and to in turn prevent movement of the backrest relative to the seat to a reclining position.

5. The recliner chair defined in claim 4 wherein said footrest actuating linkage means prevents movement of the actuating and control linkage in a direction opposite said one direction when the footrest is in retracted position.

6. The recliner chair defined in claim 5 further including second stop means for limiting movement of said suspension linkage in one direction relative to the carrier link and for limiting movement of said suspension linkage in said one direction relative to said base.

7. The recliner chair defined in claim 6 wherein said second stop means include a first stop fixed to said suspension linkage and engageable with the carrier link.

8. The recliner chair defined in claim 7 wherein said second stop means include a second stop fixed to said suspension linkage and engageable with said actuator link included in said backrest linkage means.

9. The recliner chair defined in claim 7 wherein said mounting linkage includes a mounting link having one end pivotally connected to the base and an opposite end pivotally connected to the actuating and control linkage and wherein there is further included third stop means uniting said actuating and control linkage and said mounting link when the footrest is in retracted position and during initial actuation of the footrest from the retracted position to the extended position.

10. The recliner chair defined in claim 9 wherein said footrest actuating linkage means include a drive shaft mounted in the seat for rotation about a horizontal axis, a crank fixed to the drive shaft for rotation therewith, said crank being connected to said actuating and control linkage and also being connected to said footrest linkage means to actuate the same upon rotation of the drive shaft.

11. The recliner chair defined in claim 10 wherein there is included in said footrest linkage means a fourth stop means limiting movement of said footrest linkage when moving the footrest to extended position.

12. The recliner chair defined in claim 10 further including a manual operating handle fixed to said drive shaft to rotate the same for extending or retracting the footrest.

13. The recliner chair defined in claim 10 wherein said actuating and control linkage includes a link pivotally connected to said mounting linkage and said crank and is generally aligned with the axis of rotation of said drive shaft when the footrest is in retracted position.

14. The recliner chair defined in claim 2 wherein said suspension linkage includes front and rear suspension links each pivotally connected to the carrier link and said seat link, and further wherein said mounting linkage includes front and rear mounting links each pivotally connected to said carrier link and said base.

15. The recliner chair defined in claim 14 wherein said backrest is pivotally connected to said seat link and said actuator link included in said backrest linkage is pivotally connected to said backrest and to said rear suspension link to be capable of pivoting said suspension link forwardly of the chair relative to the carrier link when the footrest is in extended position.

16. The recliner chair defined in claim 15 wherein said actuating and control linkage includes an actuating and control link pivotally connected to said rear mounting link and pivotally connected to said footrest actuating linkage means, said footrest actuating linkage being pivotally connected to said seat such that said actuating and control link prevent movements of said mounting links in a direction rearwardly of the chair when the footrest is in retracted position.

17. The recliner chair defined in claim 16 including a stop fixed to the front mounting link and engageable with the actuating and control link to prevent reclining of the backrest relative to the seat when the footrest is in retracted position, said stop being spaced from said actuating and control link when the footrest is moved to extended position thus permitting the backrest to be reclined relative to the seat.

18. The recliner chair defined in claim 17 further including a stop fixed to the front suspension link and engageable with the carrier link to limit movement of said front suspension link in one direction rearwardly of the chair relative to the carrier link.

19. The reclining chair defined in claim 18 further including a stop fixed to the rear suspension link and engageable with said actuator link included in the backrest linkage means to limit movement of the carrier link, suspension links and seat link in a direction rearwardly of the chair.

20. The recliner chair defined in claim 19 further including a stop fixed to the actuator link included in the backrest linkage means and engageable with the rear suspension link to limit reclining movement of the backrest relative to the seat.

21. The recliner chair defined in claim 20 wherein said front mounting link has a pivotal connection to said carrier link located rearwardly of the chair relative to pivotal connection of the front mounting link to the base when the footrest is in retracted position, said pivotal connection of said front mounting link to said carrier link being located forwardly of the pivotal connection of the front mounting link to the base when the footrest is in the extended position.

22. A linkage mechanism for a recliner chair of the type including a base, a seat mounted on the base for movement relative to the base between upright and reclining positions, a backrest mounted to the seat for movement with the seat relative to the base and also for movement relative to the seat between upright and reclining positions, and a footrest mounted to the seat for movement between a retracted position at the front of the seat and an extended position projected forwardly from the chair; the linkage mechanism comprising in combination, a seat link adapted to be fixed to the seat of an associated chair, a carrier link positioned above the seat link, front and rear suspension links each pivotally connected to the carrier link at locations spaced along the carrier link and also pivotally connected to the seat link at locations spaced along the longitudinal direction of the seat link for suspending the seat link from the carrier link for pivotal movement relative thereto, front and rear mounting links each pivotally connected to the carrier link at locations spaced along the carrier link and adapted to be pivotally connected to the base of an associated chair for mounting the seat of the chair relative to the base through the carrier link, a backrest link adapted to be fixed to the backrest of an associated chair and being pivotally connected to a rear portion of the seat link, an actuator link pivotally connected to the backrest link and also pivotally connected to the rear suspension link for swinging the suspension links and the seat link relative to the carrier link upon actuation of the backrest link, a footrest actuating linkage adapted to be connected to the footrest of an associated chair for actuating the footrest between extended and retracted positions relative to the chair, and an actuating and control link pivotally connected to the rear mounting link and also pivotally connected to the footrest actuating linkage for driving the rear mounting link when the associated footrest is moved to extended position, said carrier link, suspension links and seat link forming a closed four-bar linkage adapted to be moved forwardly and rearwardly of the base of an associated chair by means of the mounting links.

23. The linkage mechanism defined in claim 22 wherein there is included a first stop fixed to the front suspension link and engageable with the carrier link to limit movement of said front suspension link in one direction relative to the carrier link and wherein there is further included a second stop fixed to the rear suspension link and engageable with the actuating link which is pivoted between the backrest link and the rear suspension link for limiting movement of the said four-bar linkage in one direction relative to the mounting links.

24. The linkage mechanism defined in claim 23 further including a third stop fixed to the actuator link which is pivotally connected between the backrest link and the rear suspension link, said third stop being engageable with the rear suspension link for limiting movement of the suspension links and seat link relative to the carrier link.

25. The linkage mechanism defined in claim 23 wherein said rear mounting link includes an upper portion projecting beyond the point of pivotal connection of the rear mounting link to the carrier link and wherein said actuating and control link is pivotally connected to said last defined portion of the mounting link.

26. The linkage mechanism defined in claim 24 wherein said footrest actuating linkage includes a crank mounted for rotation on the seat link, and wherein said actuating and control link is pivotally connected to said crank.

27. The linkage mechanism defined in claim 26 wherein said footrest actuating linkage is movable by said crank between a first position for retracting an associated footrest and a second position for extending the associated footrest, and wherein there is further included a fourth stop located on the front mounting link engageable with the actuating and control link when the footrest actuating linkage is in the first position, said stop being disengageable with said actuating and control link when the footrest linkage is in said second position.

28. The linkage mechanism defined in claim 27 further including footrest linkage adapted to be connected to a footrest of an associated chair, said footrest linkage including a mounting link pivotally connected to the seat link and an actuating link pivotally connected to said crank such that movement of said footrest actuating linkage to the first position closes the footrest linkage and movement of the footrest actuating linkage to the second position opens and extends the footrest linkage.

29. The linkage mechanism defined in claim 28 wherein said footrest linkage includes a stop fixed to the mounting link included in the footrest linkage and engageable with the actuating link included in the footrest linkage when the footrest linkage is moved to extended position.

30. A recliner chair comprising in combination: a base, a seat, a carrier link, a pair of front and rear suspension links pivotally connected at their lower portions to the seat at locations spaced longitudinally along the seat in the forward-rearward direction of the chair, said suspension links having upper portions pivotally connected to the carrier link at locations spaced longitudinally along the carrier link in the forward-rearward direction of the chair to pivotally suspend the seat from the carrier link, a pair of front and rear mounting links having upper portions pivotally connected to the carrier link at locations spaced longitudinally of the carrier link and having lower portions pivotally connected to the base at locations spaced longitudinally along the base in the forward-rearward direction of the chair, a backrest pivotally connected to the seat, said carrier link, suspension links and seat forming a first closed four-bar linkage, said carrier link, mounting links and base forming a second closed four-bar linkage, a first actuator link pivotally connected to the backrest and pivotally connected to the rear suspension link for driving the first four-bar link relative to the carrier link, a footrest, footrest actuating linkage connected to the footrest for moving the footrest, a retracted position adjacent the front of the chair and an extended position projected forwardly of the chair, and an actuating and control link connected to the footrest actuating linkage and pivotally connected to one of the mounting links for moving the second four-bar linkage forwardly relative to the base when the footrest is moved to extended position.

31. The recliner chair defined in claim 30 further including first stop means for limiting movement of said suspension links in the rearward direction of the chair relative to the carrier link.

32. The recliner chair defined in claim 31 further including second stop means for limiting movement of the first four-bar linkage in the rearward direction of the chair relative to the mounting linkage.

33. The recliner chair defined in claim 32 further including third stop means preventing movement of the actuating and control link in one direction when the footrest is in retracted position for preventing movement of the suspension links and mounting links in the forward direction of the chair when the footrest is in retracted position, said third stop means being disengageable from said actuating and control link when the footrest is moved to extended position for permitting the suspension links to be moved forwardly of the chair relative to the carrier link by exertion of pressure on the backrest which transmits motion to said suspension links through said first actuator link.

34. The recliner chair defined in claim 32 wherein the pivotal connection of the front mounting link to the carrier link is positioned rearwardly of the pivotal connection of the front mounting link to the base when the footrest is in retracted position, and wherein the pivotal connection of the front mounting link to the carrier link moves forwardly of the pivotal connection of the front mounting link to the base when the footrest is moved to extended position thereby permitting further movement of the mounting links forwardly relative to the base by gravity when the suspension links are pivoted forwardly by said first actuator link after the footrest has been moved to said extended position.

* * * * *